US009480306B2

(12) United States Patent
Potterbaum

(10) Patent No.: US 9,480,306 B2
(45) Date of Patent: Nov. 1, 2016

(54) CUFF CONNECTOR FOR A FOLDED CUFF

(71) Applicant: Jefre Eugene Potterbaum, Smyrna, GA (US)

(72) Inventor: Jefre Eugene Potterbaum, Smyrna, GA (US)

( * ) Notice: Subject to any disclaimer, the term of this patent is extended or adjusted under 35 U.S.C. 154(b) by 0 days.

(21) Appl. No.: 14/220,774

(22) Filed: Mar. 20, 2014

(65) Prior Publication Data

US 2015/0265005 A1 Sep. 24, 2015

(51) Int. Cl.
*A44B 5/00* (2006.01)
*A41B 7/02* (2006.01)

(52) U.S. Cl.
CPC . *A44B 5/00* (2013.01); *A41B 7/02* (2013.01); *Y10T 24/312* (2015.01)

(58) Field of Classification Search
CPC ..... A42B 7/00; A42B 7/02; A42B 7/10; A44B 5/00; A41B 7/00; A41B 7/02; A41B 7/04; A41B 7/06; A41B 7/08; A41B 7/10; A41B 7/12; Y10T 24/312
USPC ..... D11/226; 2/123, 237, 323; 24/102 R
See application file for complete search history.

(56) References Cited

U.S. PATENT DOCUMENTS

| | | | | | |
|---|---|---|---|---|---|
| 268,102 | A | * | 11/1882 | Horton | 63/21 |
| 1,778,455 | A | * | 10/1930 | Heileman | 24/71 J |
| 2,163,208 | A | * | 6/1939 | Moody et al. | 224/177 |
| 2,608,691 | A | * | 9/1952 | Berg | 2/325 |
| 3,112,491 | A | * | 12/1963 | Cleveland | 2/90 |
| 3,522,635 | A | * | 8/1970 | Nilsson | 24/369 |
| 5,575,011 | A | * | 11/1996 | Allen | 2/227 |
| 6,044,496 | A | * | 4/2000 | Ramirez | 2/219 |
| 6,070,434 | A | * | 6/2000 | Traver | 63/1.11 |
| D698,128 | S | * | 1/2014 | Cabrera | D2/853 |
| 2002/0020001 | A1 | * | 2/2002 | Kelly | 2/123 |
| 2012/0085129 | A1 | * | 4/2012 | Kienzle et al. | 63/12 |
| 2013/0232729 | A1 | * | 9/2013 | Abadi | 24/66.4 |

FOREIGN PATENT DOCUMENTS

FR 2567005 A1 * 1/1986

* cited by examiner

*Primary Examiner* — Ismael Izaguirre
(74) *Attorney, Agent, or Firm* — Dunlap Bennett & Ludwig PLLC

(57) ABSTRACT

A cuff connector for a folded cuff is provided. The cuff connector may include a base portion that fits within and has larger dimensions than a cuff button hole. The cuff connector may further include a chain that connects the base portion to a connector. The connector is formed to releasably attach to a cuff button. Therefore, a use may fold their cuffs, place the base within the cuff button hole and attach the connector to the cuff button.

4 Claims, 2 Drawing Sheets

CUFF CONNECTOR FOR A FOLDED CUFF

BACKGROUND OF THE INVENTION

The present invention relates to a cuff connector and, more particularly, to a cuff connector for a folded cuff.

Cufflinks are used to secure French button cuffs and are also an item of jewelry for men. In their simplest form a double, colored silk knot with rubber band is used (nowadays typically made completely from rubber). Cufflinks can be manufactured from a variety of different materials, such as glass, stone, leather, metal, precious metal or combinations of these. Securing of the cufflinks is usually achieved via toggles or reverses based on the design of the front section, which can be folded into position.

Currently, during warm weather or for stylistic reasons, men enjoy folding their cuffs. However, a folded cuff lacks a professional look. Further, the folded cuff may occasionally unfold, causing a nuisance. Regular cufflinks are not able to secure a folded cuff.

As can be seen, there is a need for a device that secures a folded cuff.

SUMMARY OF THE INVENTION

In one aspect of the present invention, an apparatus comprises: a cuff connector comprising: a base having larger dimensions than a button opening of a cuff; a link having a first end and a second end, wherein the base is attached to the first end; and a connector releasably attachable to a button of a cuff, wherein the connector is attached to the second end of the link.

In another aspect of the present invention, a method of securing a folded cuff comprises: providing a cuff link comprising a base, a connector and a link connecting the base and the connector; folding a cuff of a sleeve; placing the base through a cuff button hole of the sleeve; and attaching the connector to a button on the sleeve.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention may hold a shirt cuff in place when the cuff is rolled back. When a shirt cuff is rolled back (only once) it creates a flared and unprofessional look. The present invention may pull the two ends of the cuff together giving a rolled cuff a more professional look. The present invention may include a "T" shaped handle connected to one of the ⅓ inch long links. The link is connected to the ½ inch link. The ½ inch link is connected to the other ⅓ inch link which is then connected to the hook. The "T" handle, links and hook form a connection between the two ends of a cuff on a shirt. By creating this connection the cuff is held closer to the shirt creating a more professional look.

Broadly, an embodiment of the present invention provides a cuff connector for a folded cuff. The cuff connector may include a base portion that fits within and has larger dimensions than a cuff button hole. The cuff connector may further include a chain that connects the base portion to a connector. The connector is formed to releasably attach to a cuff button. Therefore, a use may fold their cuffs, place the base within the cuff button hole and attach the connector to the cuff button.

Figure 1:
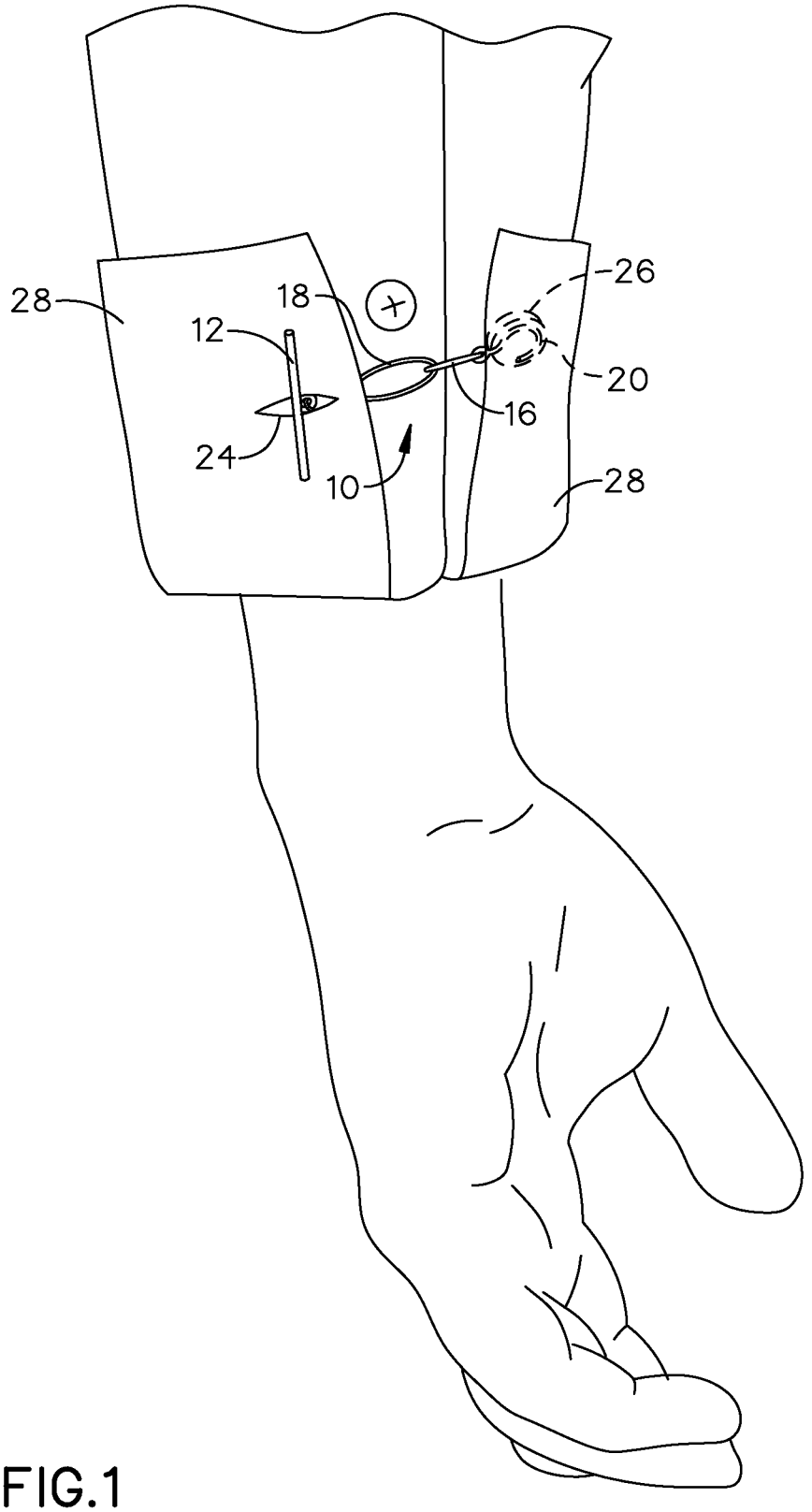
FIG. 1 is a perspective view of the present invention shown in use.
Figure 2:
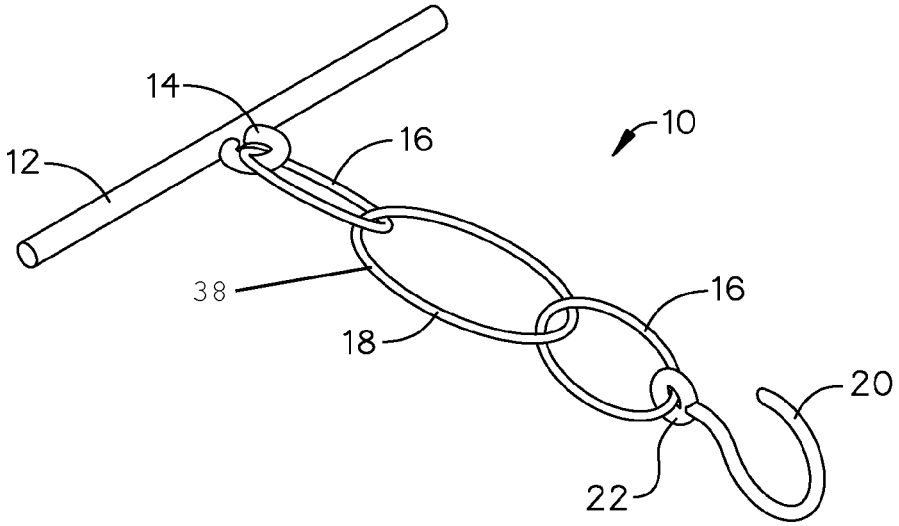
FIG. 2 is a perspective view of the present invention.
Figure 3:
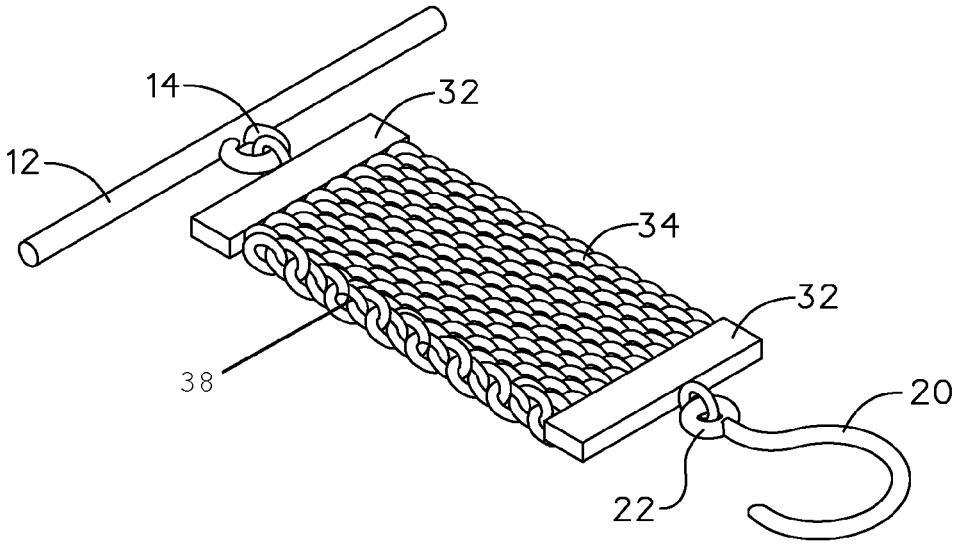
FIG. 3 is a perspective view of an alternate embodiment of the present invention.

Referring to FIGS. 1 through 3, the present invention includes a cuff connector 10. The cuff connector 10 includes a base 12 having larger dimensions than a button opening 24 of a cuff 28. The base 12 may further include a link 38. The link 38 may include a first end and a second end. The base 12 may be attached to the first end of the link 18. The present invention may further include a connector 20. The connector 20 may be attached to the second end of the link 38. The connector 20 may be releasably attachable to a cuff button 26 of the cuff 28.

In certain embodiments, the base 12 may be larger than the button opening 24 so that the base 12 may be inserted into the button opening 24 and retain through the opening 24. In certain embodiments, the base 12 may be a bar having a length greater than the size of the button opening 24. However, the base 12 is not limited to a bar and may be any desired shape. Similar to cufflinks, the base 12 and connector 20 may include a decoration or customized piece, such as a team name or logo.

In certain embodiments, the link 38 may be a chain. In such embodiments, the base 12 may include a base eye 14 and the connector may include a connector eye 22. The chain may connect to the base eye 14 on a first end and the connector eye 22 on a second end. In certain embodiments, the chain may include a first hoop link 16, a second hoop link 18, and a third hoop link 16. The first hoop link 16 may be connected with the base eye 14 and the third hoop link 16 may connect with the connector eye 22. The second hoop link 18 may connect the first hoop link 16 and the third link 16 together. The chain may include a different amount of hoop links depending on the length of the chain desired.

The link 38 may include different designs. For example, as illustrated in FIG. 3, the link 38 may be a braided chain 34. In such embodiments, the present invention may include a first chain bar 32 attached to the base 12 and a second chain bar 32 attached to the connector 22. Thereby, the first chain bar 32 may be attached to the base eyelet 14 and the second chain bar 32 may be attached to the connector eyelet 22. The braided chain 34 may connect the first chain bar 32 to the second chain bar 32.

The connector 20 may be any connector 20 that releasably attaches to the cuff button 24 that is meant to fit within the button hole 24 on the cuff 28. As illustrated in the drawings, the connector 20 may include a hook that is formed to fit around and attach to the button 24. However, the connector 20 may include any connector 20 that may attach to the cuff button 24 such as a clip, strap, and the like.

The present invention may further include a method of securing a folded cuff. The method may include the following steps: providing a cuff link comprising a base, a connector and a link connecting the base and the connector; folding a cuff of a sleeve; placing the base through a cuff button hole of the sleeve; and attaching the connector to a button on the sleeve, wherein the button is formed to secure within the button opening when the sleeve is unfolded.

It should be understood, of course, that the foregoing relates to exemplary embodiments of the invention and that modifications may be made without departing from the spirit and scope of the invention as set forth in the following claims.

What is claimed is:

1. A method of securing a folded cuff comprising:

providing a cuff link comprising a base, a connector and a link connecting the base and the connector, wherein the link comprises a first chain bar attached to the base and a second chain bar attached to the connector;

folding a cuff of a sleeve;

placing the base through a cuff button hole of the sleeve; and attaching the connector to a cuff button on the sleeve.

2. The method of claim 1, wherein the base comprises a bar having a length greater than the size of the button opening.

3. The method of claim 1, further comprising a braided chain attaching the first chain bar to the second chain bar.

4. The method of claim 1, wherein the connector comprises a hook.

* * * * *